US009403654B2

(12) United States Patent
Kawamoto et al.

(10) Patent No.: US 9,403,654 B2
(45) Date of Patent: Aug. 2, 2016

(54) STACKER AND RECORDING APPARATUS

(71) Applicant: SEIKO EPSON CORPORATION, Tokyo (JP)

(72) Inventors: Makoto Kawamoto, Matsumoto (JP); Satoru Shiohara, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/540,692

(22) Filed: Nov. 13, 2014

(65) Prior Publication Data

US 2015/0151943 A1 Jun. 4, 2015

(30) Foreign Application Priority Data

Nov. 29, 2013 (JP) ..... 2013-247387

(51) Int. Cl.
*B65H 31/02* (2006.01)
*B65H 15/00* (2006.01)
*B65H 29/26* (2006.01)

(52) U.S. Cl.
CPC ..... *B65H 31/02* (2013.01); *B65H 15/00* (2013.01); *B65H 29/26* (2013.01); *B65H 2301/333* (2013.01); *B65H 2301/33214* (2013.01); *B65H 2301/4212* (2013.01); *B65H 2301/446* (2013.01); *B65H 2301/4461* (2013.01); *B65H 2404/692* (2013.01); *B65H 2801/03* (2013.01); *B65H 2801/12* (2013.01); *B65H 2801/15* (2013.01)

(58) Field of Classification Search
CPC ..... B65H 31/02; B65H 31/00; B65H 15/00; B65H 29/40; B65H 29/26
See application file for complete search history.

(56) References Cited

U.S. PATENT DOCUMENTS

| | | | | | |
|---|---|---|---|---|---|
| 4,220,323 | A | * | 9/1980 | Smith | 271/65 |
| 4,671,503 | A | * | 6/1987 | Uemori | 271/65 |
| 5,094,441 | A | * | 3/1992 | Sebileau | 271/186 |
| 5,157,450 | A | * | 10/1992 | Kim | 399/405 |
| 8,387,973 | B1 | * | 3/2013 | Fernandez et al. | 271/175 |
| 2010/0187744 | A1 | * | 7/2010 | Hirabayashi | 270/52.09 |

FOREIGN PATENT DOCUMENTS

| | | | |
|---|---|---|---|
| JP | 62136473 A | * | 6/1987 |
| JP | 01-167174 | | 6/1989 |

* cited by examiner

*Primary Examiner* — Luis A Gonzalez
(74) *Attorney, Agent, or Firm* — Workman Nydegger

(57) ABSTRACT

A stacker on which a sheet that has entered with a direction intersecting a vertical direction as an approach direction in a state where a recording surface faces upward in the vertical direction is loaded in a state where the recording surface faces downward in the vertical direction, includes: an elastic plate capable of applying a pushing force to the sheet from a non-recording surface that is the rear surface of the recording surface; and a medium loading section on which the cut sheet can be loaded.

14 Claims, 11 Drawing Sheets

STACKER AND RECORDING APPARATUS

BACKGROUND

1. Technical Field

The present invention relates to a stacker on which a medium such as paper is loaded, and a recording apparatus which is provided with the stacker.

2. Related Art

In the related art, as one type of a recording apparatus, a recording apparatus which records (prints) a letter, an image, or the like on a medium such as paper is known. As such a recording apparatus, there is a recording apparatus (an image forming apparatus) which is provided with a recording section which performs recording on paper along a transport direction of the paper and a stacker on which the recorded paper is loaded in a state where the front and the back of the paper are reversed (for example, JP-A-1-167174).

Incidentally, the stacker in the recording apparatus as described above has a U-shaped transport guide which guides the recorded paper along the transport direction of the paper from both sides in a thickness direction of the paper, a transport roller which is provided in the middle of the transport guide and applies a transport force to the paper, and a paper discharge tray on which the paper discharged from the transport guide is loaded.

For this reason, in the stacker in the recording apparatus as described above, there is a problem in that the configuration of the stacker is complicated due to providing the transport guide, the transport roller, a drive source which drives the transport roller, and the like.

SUMMARY

An advantage of some aspects of the invention is that it provides a stacker in which it is possible to load a medium thereon with the front and the back of the medium reversed with a simple configuration, and a recording apparatus which is provided with the stacker.

Hereinafter, means of the invention and an operation and effects thereof will be described.

According to an aspect of the invention, there is provided a stacker on which a medium that has entered with a direction intersecting a vertical direction as an approach direction in a state where a first surface faces upward in the vertical direction is loaded in a state where the first surface faces downward in the vertical direction, the stacker including: a pushing force applying section capable of applying a pushing force to the entered medium from a second surface that is a rear surface of the first surface; and a medium loading section which is provided further toward the lower side in the vertical direction than the pushing force applying section and on which the medium can be loaded.

According to the above configuration, the medium entering the stacker in a state where the first surface faces upward in the vertical direction is applied with a pushing force from the second surface by the pushing force applying section. Here, it is assumed that the pushing force applying section applies the pushing force to a rear end portion entering the stacker at the end, which is the side opposite to a leading end portion first entering the stacker, from the second surface. Then, due to the pushing force acting on the medium, a moment to rotate the rear end portion of the medium with the leading end side further than the rear end portion as a rotation center acts on the medium. That is, the medium rotates due to such a moment, whereby the front and the back of the medium are reversed, and thus the medium is changed from a state where the first surface faces upward in the vertical direction to a state where the first surface faces downward in the vertical direction. That is, the medium is changed from a state where the second surface faces downward in the vertical direction to a state where the second surface faces upward in the vertical direction. Then, the medium falling downward in the vertical direction due to its own weight is loaded on the medium loading section. In this way, in the above configuration, it becomes possible to reverse the front and the back of the medium entering the stacker, by simply applying the pushing force to the rear end portion of the medium. Therefore, it is possible to load the medium with the front and the back of the medium reversed with a simple configuration.

In the above stacker, it is preferable that the pushing force applying section be able to support the medium by coming into contact with the second surface of the medium, be able to be displaced from a first position toward a second position that is a position further toward the lower side in the vertical direction than the first position, and be biased toward the first position from the second position.

If the medium enters the stacker, the medium is supported from the lower side in the vertical direction by the pushing force applying section. Here, the pushing force applying section supports the medium, whereby the medium's own weight acts on the pushing force applying section, and therefore, the medium's own weight acting on the pushing force applying section gradually increases according to an increase in the amount of approach of the medium with respect to the stacker. That is, the pushing force applying section is gradually displaced toward the second position from the first position. Then, if the rear end portion of the medium entering the stacker reaches the pushing force applying section, the medium's own weight acting on the pushing force applying section gradually decreases, and thus the pushing force applying section is gradually displaced (restored) from the second position to the first position. Then, the pushing force applying section applies a pushing force to the rear end portion of the medium from the second surface according to the displacement. In this way, a moment to rotate the rear end portion of the medium with the leading end side further than the rear end portion, to which the pushing force is applied, as a rotation center, acts on the medium. That is, due to such a moment, the front and the back of the medium are reversed, and thus the medium is changed from a state where the first surface faces upward in the vertical direction to a state where the first surface faces downward in the vertical direction. Therefore, according to the above configuration, a support aspect of the pushing force applying section with respect to the medium changes according to an increase in the amount of approach of the medium with respect to the stacker. Then, the pushing force is applied to the rear end portion of the medium based on such a change in support aspect. For this reason, it is possible to apply the pushing force to the rear end portion of the medium with a simple configuration.

In the above stacker, it is preferable that the pushing force applying section be elastically deformable.

According to the above configuration, when supporting the medium, the pushing force applying section itself is elastically deformed, whereby the pushing force applying section is displaced toward the second position from the first position. Further, when applying the pushing force to the rear end portion of the medium, the pushing force applying section is displaced (restored) toward the first position from the second position due to elastic energy stored in the pushing force applying section by elastic deformation thereof. Then, when the pushing force applying section is displaced toward the first position from the second position, the pushing force applying section applies a pushing force to the medium. In this way, according to the above configuration, since the pushing force applying section can be configured with a single member, a biasing member for biasing the pushing force applying section is not required, and thus it is possible to simplify the configuration of the stacker.

In the above stacker, it is preferable that the pushing force applying section apply a pushing force to the medium by blowing gas on the second surface of the medium.

According to the above configuration, the pushing force applying section blows gas on the rear end portion of the medium, thereby applying a pushing force to the medium, and thus it becomes possible to reverse the front and the back of the medium. For this reason, in the reversing of the front and the back of the medium, the medium and the pushing force applying section are prevented from performing contact or sliding with respect to each other. For this reason, it is possible to reverse the front and the back of the medium without applying a pushing force by a physical contact with the medium.

It is preferable that the above stacker further include: a medium guide section which is provided further toward the lower side in the vertical direction than an approach position and has an inclined surface which is directed downward in the vertical direction as it goes forward in the approach direction.

In a medium having a curling tendency to allow a first surface to be located outside and allow a second surface to be located inside, compared to a medium without such a curling tendency, it is difficult to load the medium on the medium loading section with the front and the back of the medium reversed. According to the above configuration, when such a medium having a curling tendency enters the stacker, a leading end of the medium comes into contact with the inclined surface provided further toward the lower side in the vertical direction than the approach position, whereby the medium advancing into the stacker is prevented from being curved (curled). For this reason, compared to a case where the inclined surface is not provided, it is possible to easily reverse the front and the back of the medium.

In the above stacker, it is preferable that the medium guide section have a positioning portion which determines a relative position with respect to the medium loading section in the approach direction and the vertical direction.

According to the above configuration, it is possible to load the medium on the medium loading section in a state where a relative positional relationship between the medium loading section and the medium guide section is positioned. For this reason, for example, in a case where a plurality of media are loaded on the stacker, it is possible to prevent variation from occurring in loading positions of the plurality of media with respect to the medium loading section. Therefore, it is possible to prevent occurrence of poor loading of the medium due to variation in the loading position of the medium.

In the above stacker, it is preferable that the medium guide section have the plurality of positioning portions.

In a case where the sizes of the media entering the stacker are different from each other, moving paths that the media take when the front and the back of the medium are reversed are often different from each other. According to the above configuration, by selectively using the plurality of positioning portions, it becomes possible to change a relative positional relationship between the medium guide section and the medium loading section. Therefore, by setting such a positional relationship to be a positional relationship most suitable for the size of the medium entering the stacker, it is possible to properly load the media having different sizes on the medium loading section.

In the above stacker, it is preferable that the medium loading section have an inclined loading portion having an inclined surface which is directed upward in the vertical direction as it goes forward in the approach direction.

According to the above configuration, in the medium loading section, at least a portion of the medium is loaded on the inclined loading portion, and therefore, at least a portion of the medium is loaded in a state of being inclined in a direction intersecting the approach direction and the vertical direction. Therefore, compared to the case of a medium loading section on which the entirety of the medium is loaded in a state of extending in the approach direction, it is possible to shorten the length dimension in the approach direction of the medium loading section. Therefore, it is possible to make the stacker compact in the approach direction.

According to another aspect of the invention, there is provided a recording apparatus including: the stacker described above; and a recording section which performs recording on the medium.

According to the above configuration, it is possible to obtain the same operation and effects as the operation and effects that the above-described stacker exhibits.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a recording apparatus provided with a stacker will be described with reference to the drawings. The recording apparatus is, for example, an ink jet type printer which performs recording (printing) by ejecting ink onto a medium such as paper.

Figure 1:
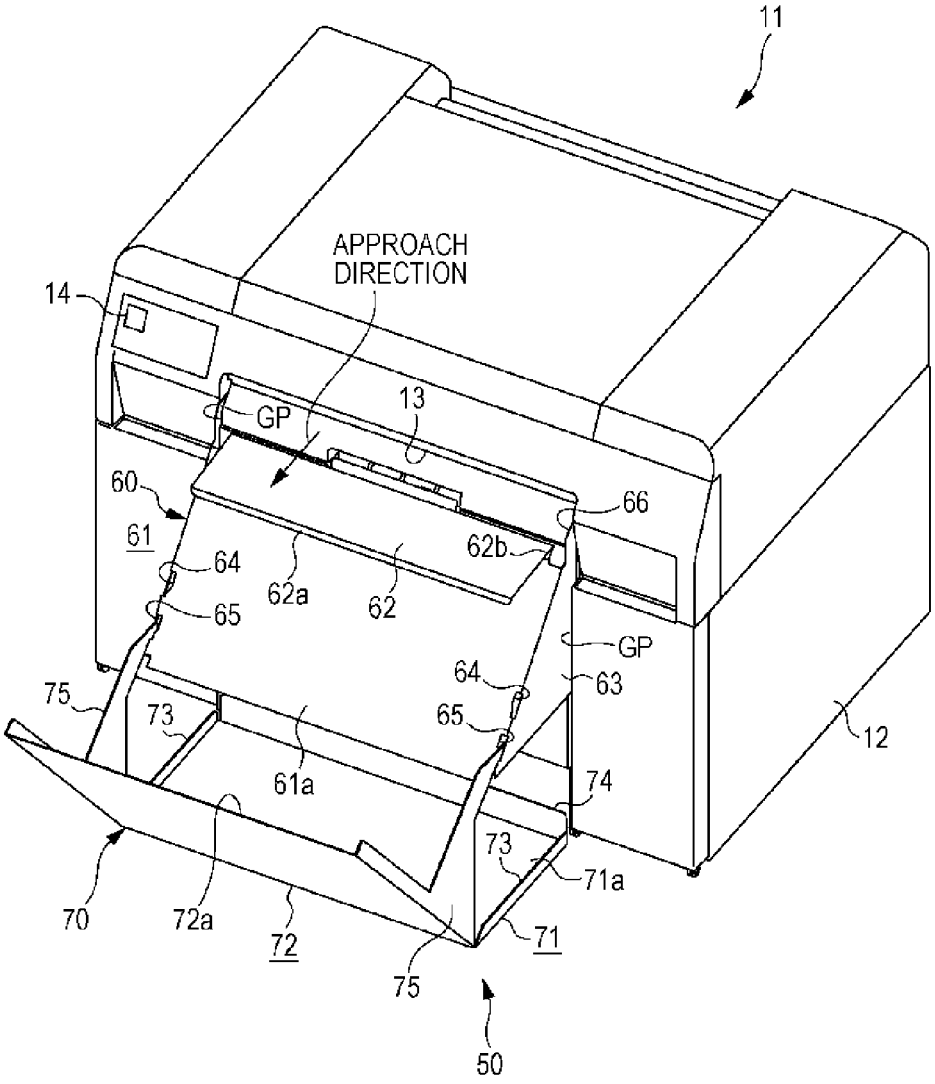
FIG. 1 is a perspective view of a recording apparatus according to an embodiment.

As shown in FIG. 1, a recording apparatus 11 according to this embodiment is provided with a housing section 12 which serves as an outer covering portion of the recording apparatus 11, and a stacker 50 on which a recorded cut sheet CP (refer to FIG. 6) is loaded. In the front surface of the housing section 12, a discharge port 13 through which a recorded sheet S (refer to FIG. 2) is discharged is provided at a position corresponding to the upper side in a vertical direction of the stacker 50. Further, in the front surface of the housing section 12, an operating section 14 for performing an operation of the recording apparatus 11 is provided.

Figure 2:
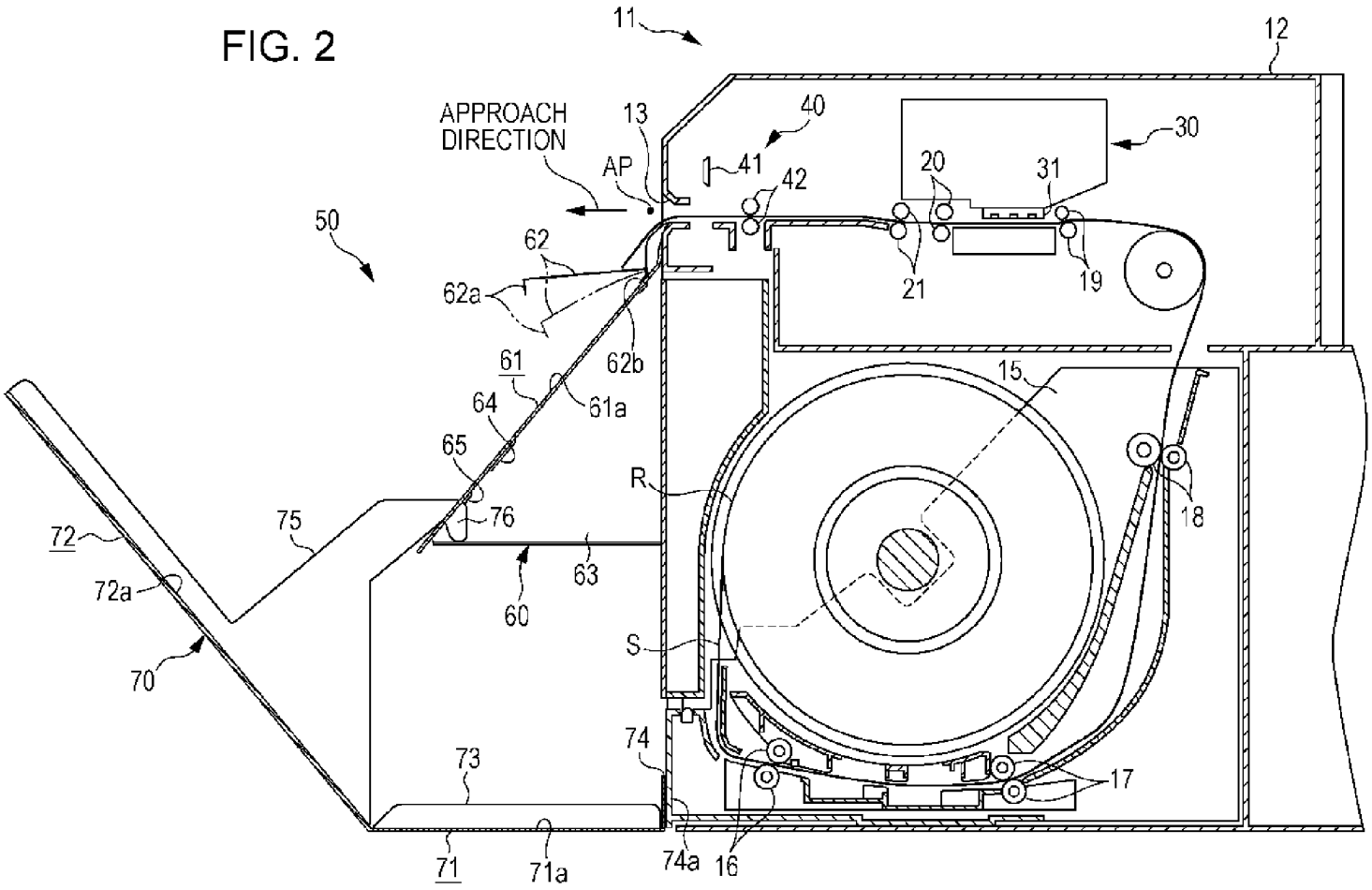
FIG. 2 is a cross-sectional side view of the recording apparatus.

As shown in FIG. 2, in the housing section 12, a roll body R formed by winding the sheet S, and a medium holding section 15 which rotatably holds the roll body R with a width direction of the housing section 12 as a rotation axis direction are provided. Further, in the housing section 12, transport rollers 16, 17, 18, 19, 20, and 21 are provided which apply a transport force to the sheet S when transporting the sheet S unwound from the roll body R toward the downstream side on which there is the discharge port 13.

Further, a recording section 30 which performs recording on the sheet S unwound from the roll body R, and a cutting section 40 which produces the cut sheet CP by cutting the sheet S with recording performed thereon by the recording section 30 are provided above a space in which the medium holding section 15 is accommodated. The recording section 30 is provided with a liquid ejecting head 31 capable of ejecting ink that is an example of a recording material onto the sheet S. Further, the cutting section 40 is provided with a cutter 41 which cuts the sheet S, and a pinching roller pair 42 which fixes the sheet S when the cuter 41 cuts the sheet S. Further, the pinching roller pair 42 fixes the sheet S by pinching the sheet S from the top and the bottom in the vertical direction further on the upstream side in a transport direction than the cutter 41.

Next, the stacker 50 will be described. In addition, in the following description, the upper side and the lower side in the vertical direction are also referred to simply as an upper side and a lower side. Further, a position where the sheet S enters the stacker 50 is referred to as an approach position AP, and a direction in which the sheet S enters the stacker 50 is referred to as an approach direction. In addition, the approach direction is a direction in which the sheet S advances at the discharge port 13 of the recording apparatus 11 and is a direction in which the sheet S is discharged from the housing section 12.

As shown in FIGS. 1 and 2, the stacker 50 is provided with a medium guide section 60 which guides the sheet S discharged from the discharge port 13 of the recording apparatus 11 further on the lower side than the approach position AP, and a medium loading section 70 on which the sheet S guided by the medium guide section 60 is loaded further on the lower side in the vertical direction than the medium guide section 60.

The medium guide section 60 has an inclined portion 61 having an inclined surface 61*a* which is directed downward in the vertical direction as it advances forward (in FIG. 2, in a left direction) in the approach direction, an elastic plate 62 which supports the sheet S while being elastically deformed, and side wall portions 63 which extend in a direction intersecting the width direction of the recording apparatus 11 at both ends in the width direction.

In the inclined portion 61, locking holes 64 and 65 are formed to penetrate in a direction intersecting the inclined surface 61*a* at both ends in the width direction and at positions closer to the lower side. The locking hole 64 is formed in the inclined surface 61*a* at a relatively high position in the vertical direction, and the locking hole 65 is formed in the inclined surface 61*a* at a relatively low position in the vertical direction. In addition, the distance between each of the locking holes 64 and 65 on one end side in the width direction and each of the locking holes 64 and 65 on the other end side is made longer than the width dimension of the sheet S on which the recording apparatus 11 can perform recording. For this reason, the sheet S passes between the locking holes 64 and 65 on one end side and the locking holes 64 and 65 on the other end side in the stacker 50.

The elastic plate 62 has an approximately rectangular plate shape having a longitudinal direction in the width direction of the stacker 50 and a short side direction in a direction along the approach direction of the sheet S. A front end and a rear end in the approach direction of the elastic plate 62 respectively have bent portions 62*a* and 62*b* formed by being bent so as to be directed downward in the vertical direction. The bent portions 62*a* and 62*b* of the front end and the rear end in the approach direction are provided in order to increase rigidity against bending or torsion with the longitudinal direction of the elastic plate 62 as an axial direction of a neutral axis. In addition, the bent portion 62*b* of the rear end in the approach direction is provided in order to form a margin when bonding the elastic plate 62 to the inclined surface 61*a* of the inclined portion 61. Further, the elastic plate 62 is attached to the inclined portion 61 (the inclined surface 61*a*) at a position corresponding to an upper end in the vertical direction of the inclined surface 61*a* and below the approach position AP of the sheet S to the stacker 50. As an attachment aspect of the elastic plate 62 to the inclined portion 61, besides adhesion, the elastic plate 62 may be fixed to the inclined portion 61 by a screw, the elastic plate 62 may be welded to the inclined portion 61, or the inclined portion 61 and the elastic plate 62 may be integrally formed in advance.

Further, the elastic plate 62 can be displaced toward a "second position" shown by a two-dot chain line in FIG. 2 from a "first position" shown by a solid line in FIG. 2. That is, in FIG. 2, the elastic plate 62 is elastically deformed toward the second position shown by a two-dot chain line due to a load which is applied downward in the vertical direction at the first position shown by a solid line where the elastic plate 62 is located when a load is not applied thereto. Further, in a state where the elastic plate 62 is located at the second position, elastic energy is stored in the elastic plate 62, and therefore, if the above-described load is eliminated, the elastic plate 62 is restored toward the first position from the second position. For this reason, it can also be said that the elastic plate 62 is biased toward the first position from the second position. In addition, as long as the elastic plate 62 can be elastically deformed due to a load corresponding to its own weight of the sheet S, the elastic plate 62 may be made of a rubber material, may be made of a resin material, may be made of a metal material, or may be made of other materials. Further, the elastic plate 62 which has an approximately rectangular plate shape having a short side direction in the width direction of the stacker 50 and a longitudinal direction in a direction along the approach direction of the sheet S may be disposed in a plurality in the width direction. Further, a configuration is also acceptable in which the elastic plate 62 is disposed at approximately the same height as the discharge port 13, thereby allowing the sheet S which is discharged from the discharge port 13 to be led to the stacker 50 along the upper surface of the elastic plate 62. Further, the first position and the second position are not limited to locations shown in the drawing. For example, if it does not become a hindrance when the sheet S enters the stacker 50, the elastic plate 62 may be mounted such that the bent portion 62*a* side becomes higher than the bent portion 62*b* side. Further, the elastic plate 62 may have a configuration in which the elastic plate 62 is bent until it comes into contact with the inclined surface 61*a* of the inclined portion 61. A mounting method or an amount of bending (an amount of displacement) is also changed according to a material which is selected.

Figure 3:
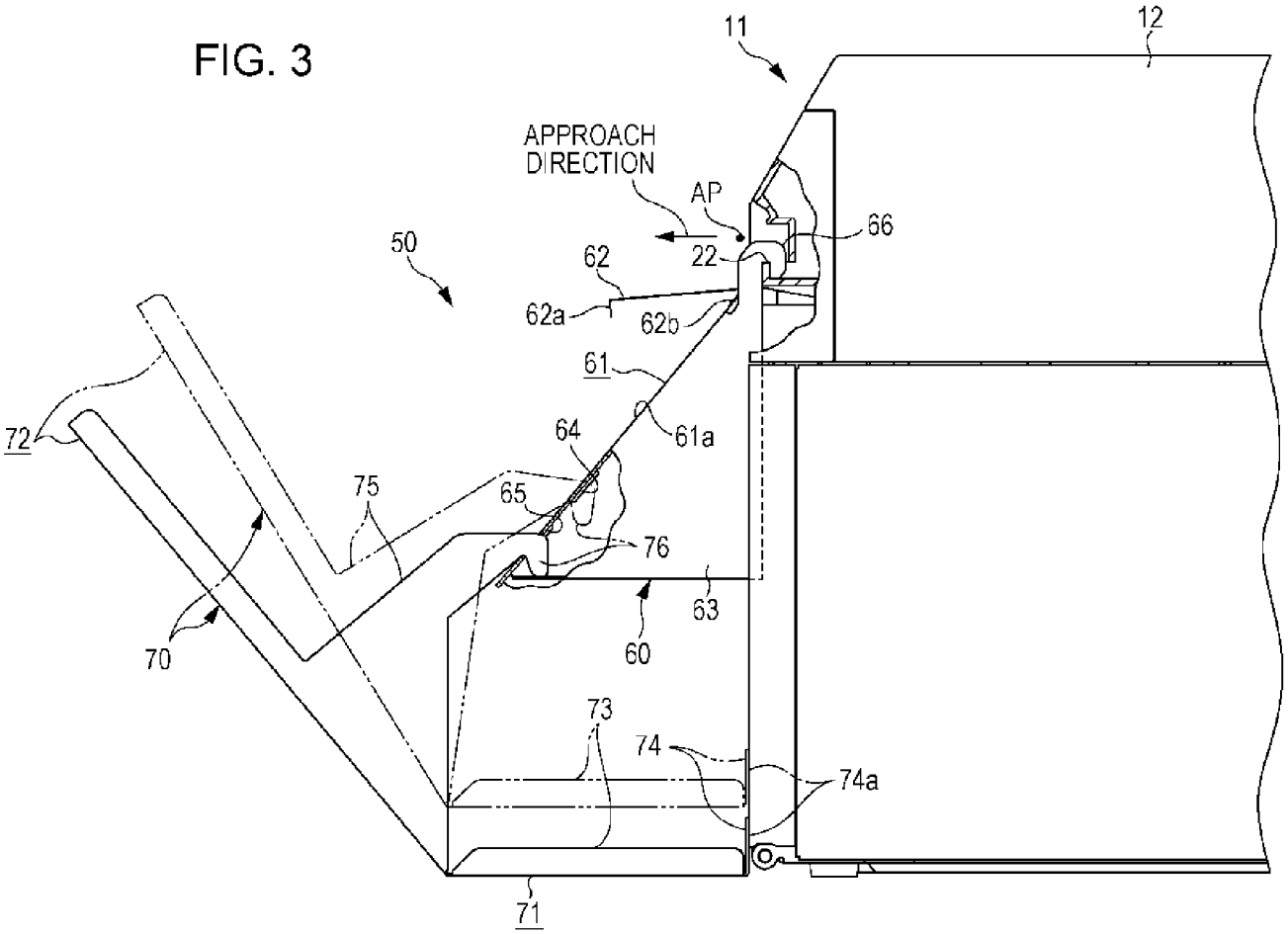
FIG. 3 is a side view of the recording apparatus.

Further, as shown in FIG. 3, an upper end portion of each of the side wall portions 63 of the medium guide section 60 becomes an engagement portion 66 formed in the form of a hook facing backward (in FIG. 3, in a right direction) in the approach direction. In addition, FIG. 3 shows a partial side cross-section further on the outside in the width direction than the discharge port 13 of the recording apparatus 11, and therefore, the discharge port 13 is not shown in FIG. 3. The engagement portion 66 can be engaged with an engaged portion 22 formed to be bent upward in the housing section 12, through a gap GP (refer to FIG. 1) formed in the housing section 12. In this way, the stacker 50 is retained in the recording apparatus 11 through the medium guide section 60. That is, the stacker 50 according to this embodiment is made to be detachable with respect to the recording apparatus 11 on the assumption that the engaged portion 22 is formed in the recording apparatus 11. For this reason, when maintenance of the recording apparatus 11 is performed or the roll body R is replaced, it is possible to accordingly easily remove the stacker 50.

As shown in FIGS. 1 and 2, the medium loading section 70 is provided with a first loading portion 71 having a first loading surface 71*a* extending in a direction intersecting the vertical direction, and a second loading portion 72 having a second loading surface 72*a* which is directed upward in the vertical direction as it goes forward in the approach direction. Here, the first loading portion 71 and the second loading portion 72 are connected so as to be able to change an angle which is formed between the first loading surface 71*a* and the second loading surface 72*a*.

The first loading portion 71 has first side wall portions 73 extending upward in the vertical direction intersecting the first loading surface 71*a* at both ends in the width direction of the stacker 50, and an upright portion 74 extending upward in the vertical direction intersecting the first loading surface 71*a* at a rear end thereof in the approach direction. The first side wall portions 73 are provided in order to restrict the movement of the cut sheet CP in the width direction when the cut sheet CP is loaded on the first loading surface 71*a* of the first loading portion 71. Similarly, the upright portion 74 is provided in order to restrict the movement of the cut sheet CP to the rear in the approach direction when the cut sheet CP is loaded on the first loading surface 71*a* of the first loading portion 71. Further, as shown in FIG. 2, the surface on the rear side in the approach direction of the upright portion 74 becomes a contact surface 74*a* capable of coming into surface contact with the front surface of the housing section 12. The contact surface 74*a* of the upright portion 74 comes into surface contact with the front surface of the recording apparatus 11, thereby restricting the movement of the medium loading section 70 to the rear in the approach direction with respect to the recording apparatus 11 or restricting the rotation of the medium loading section 70 with the width direction of the stacker 50 as a rotation axis direction.

As shown in FIGS. 1 and 2, the second loading portion 72 has second side wall portions 75 extending in a direction intersecting the second loading surface 72*a* at both ends in the width direction thereof. The second side wall portions 75 are provided in order to restrict the movement in the width direction of the cut sheet CP when the cut sheet CP is loaded on the second loading surface 72*a* of the second loading portion 72. Here, the first loading portion 71 allows the cut sheet CP to be loaded along the approach direction on the first loading surface 71*a*, whereas the second loading portion 72 allows the cut sheet CP to be loaded along a direction intersecting the approach direction and the vertical direction on the second loading surface 72*a*. In such a point, in this embodiment, the second loading portion 72 having the second loading surface 72*a* is equivalent to an example of an "inclined loading portion having an inclined surface".

Further, as shown in FIG. 3, in each of the second side wall portions 75, a locking portion 76 formed in the form of a hook facing rearward in the approach direction is formed. The locking portion 76 of the second side wall portion 75 is made so as to be able to be locked to the locking hole 64 or 65 formed in the inclined portion 61 of the medium guide section 60. That is, in a case where the locking portion 76 of the second side wall portion 75 is locked to the locking hole 65 of the medium guide section 60, the medium loading section 70 is relatively positioned at a position shown by a solid line in FIG. 3 with respect to the medium guide section 60. Further, in a case where the locking portion 76 of the second side wall portion 75 is locked to the locking hole 64 of the medium guide section 60, the medium loading section 70 is relatively positioned at a position shown by a two-dot chain line in FIG. 3 with respect to the medium guide section 60.

In addition, if the positions of the medium loading section 70 which are shown by a solid line and a two-dot chain line in FIG. 3 are compared to each other, while the positions in the vertical direction of the first loading portion 71 are different from each other, the angles of the first loading surface 71*a* are equal to each other. Further, the positions in the vertical direction of the second loading portion 72 are different from each other and the angles of the second loading surface 72*a* are also different from each other. In this way, it becomes possible to position the medium loading section 70 at a position suitable for the size of the cut sheet CP which is loaded on the medium loading section 70. In such a point, in this embodiment, each of the locking holes 64 and 65 provided in the inclined portion 61 is equivalent to an example of a "positioning portion".

Next, an operation of the stacker 50 with which the recording apparatus 11 according to this embodiment is provided will be described.

As shown in FIG. 2, in a case of performing recording on the sheet S, the transport rollers 16 to 21 are driven, whereby the sheet S in a state of being wound into the roll body R is unwound and the sheet S is transported toward the discharge port 13. If the sheet S is transported to the recording section 30, ink is ejected from the liquid ejecting head 31 to the sheet S, whereby recording (printing) is performed on the sheet S. That is, in a state where recording is being performed on the sheet S, a state is created where the recording surface of the sheet S faces upward in the vertical direction and the non-recording surface of the sheet S faces downward in the vertical direction. In addition, a "state where a surface faces upward in the vertical direction" indicates that when a vertical line is depicted from the upper side in the vertical direction to the sheet S, any surface of the recording surface and the non-recording surface comes into contact with the vertical line. For this reason, the state is not limited to a state where the surface on any one side of the sheet S is orthogonal to the vertical direction. Similarly, a "state where a surface faces downward in the vertical direction" indicates that when a vertical line is depicted from the lower side in the vertical direction to the sheet S, any surface of the recording surface and the non-recording surface comes into contact with the vertical line. Further, in this embodiment, the recording surface is equivalent to an example of a "first surface" and the non-recording surface is equivalent to an example of a "second surface" which is the rear surface of the first surface. In addition, according to the configuration of the recording section 30, there is also a case where the first surface becomes the non-recording surface and the second surface becomes the recording surface and there is also a case where both the first surface and the second surface become the recording surfaces.

Figure 4:
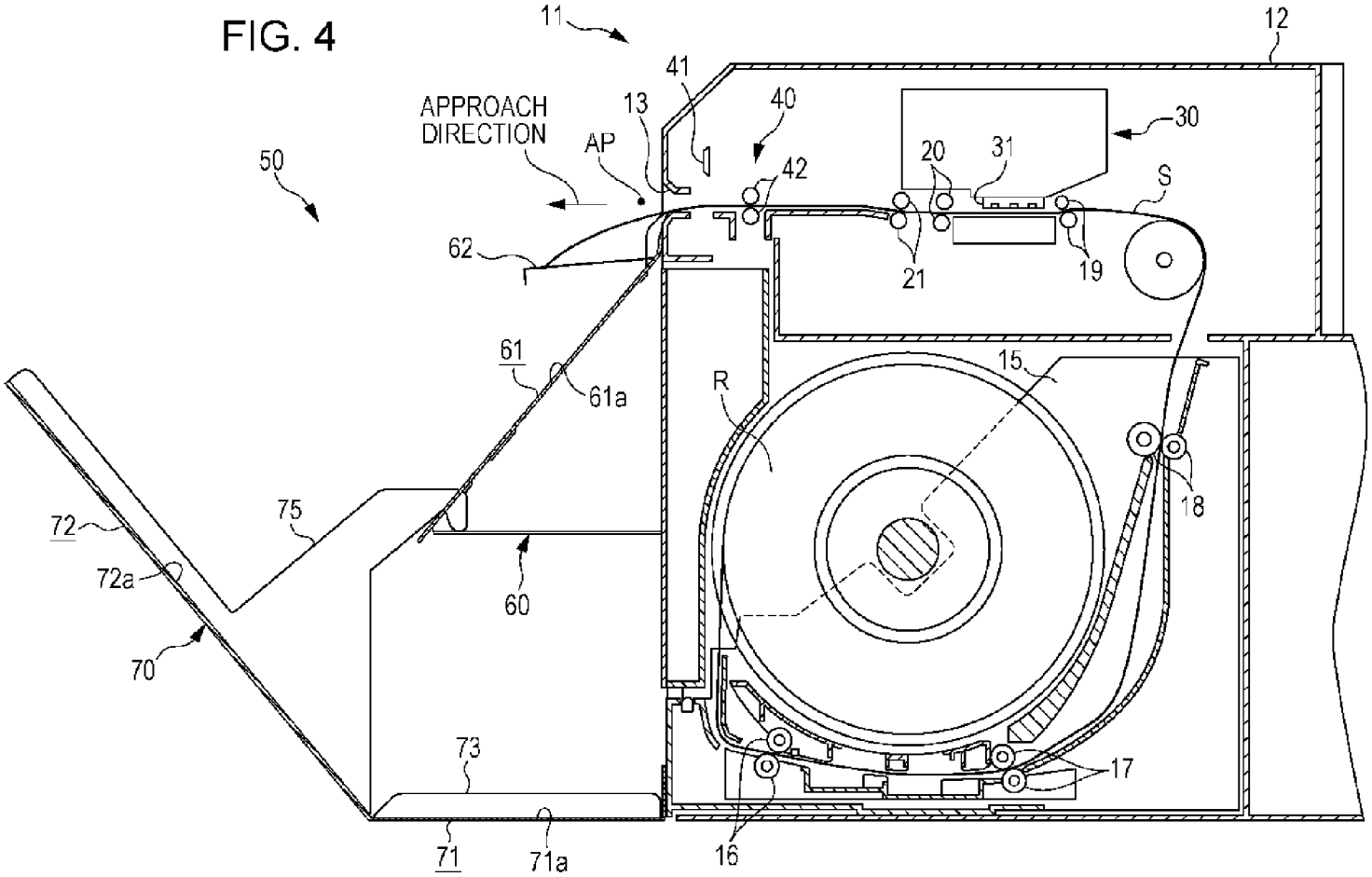
FIG. 4 is a cross-sectional side view showing a state where a sheet begins to be discharged in the recording apparatus.

As shown in FIG. 4, if recording is performed on the sheet S, the recorded sheet S is transported further downstream in the transport direction than the recording section 30 in order to produce the cut sheet CP by cutting the recorded sheet S. In addition, according to the size of an image which is recorded, there is also a case where the discharge of the sheet S is performed through the discharge port 13 of the recording apparatus 11 while recording is being performed on the sheet S. If the sheet S is discharged from the discharge port 13 to the outside of the recording apparatus 11, the discharged sheet S is bent (displaced) downward in the vertical direction due to its own weight, whereby a leading end of the sheet S comes into contact with the elastic plate 62 provided below the discharge port 13. Subsequently, the amount of approach of the sheet S with respect to the stacker 50 gradually increases, whereby the transition from a state where the leading end of the sheet S comes into contact with the elastic plate 62 to a state where the non-recording surface of the sheet S comes into contact with the elastic plate 62 is made. Then, the amount of approach of the sheet S with respect to the stacker 50 further increases, whereby the non-recording surface of the sheet S sequentially slides on the elastic plate 62. That is, in this embodiment, the recording surface of the sheet S never slides on the elastic plate 62.

Figure 5:
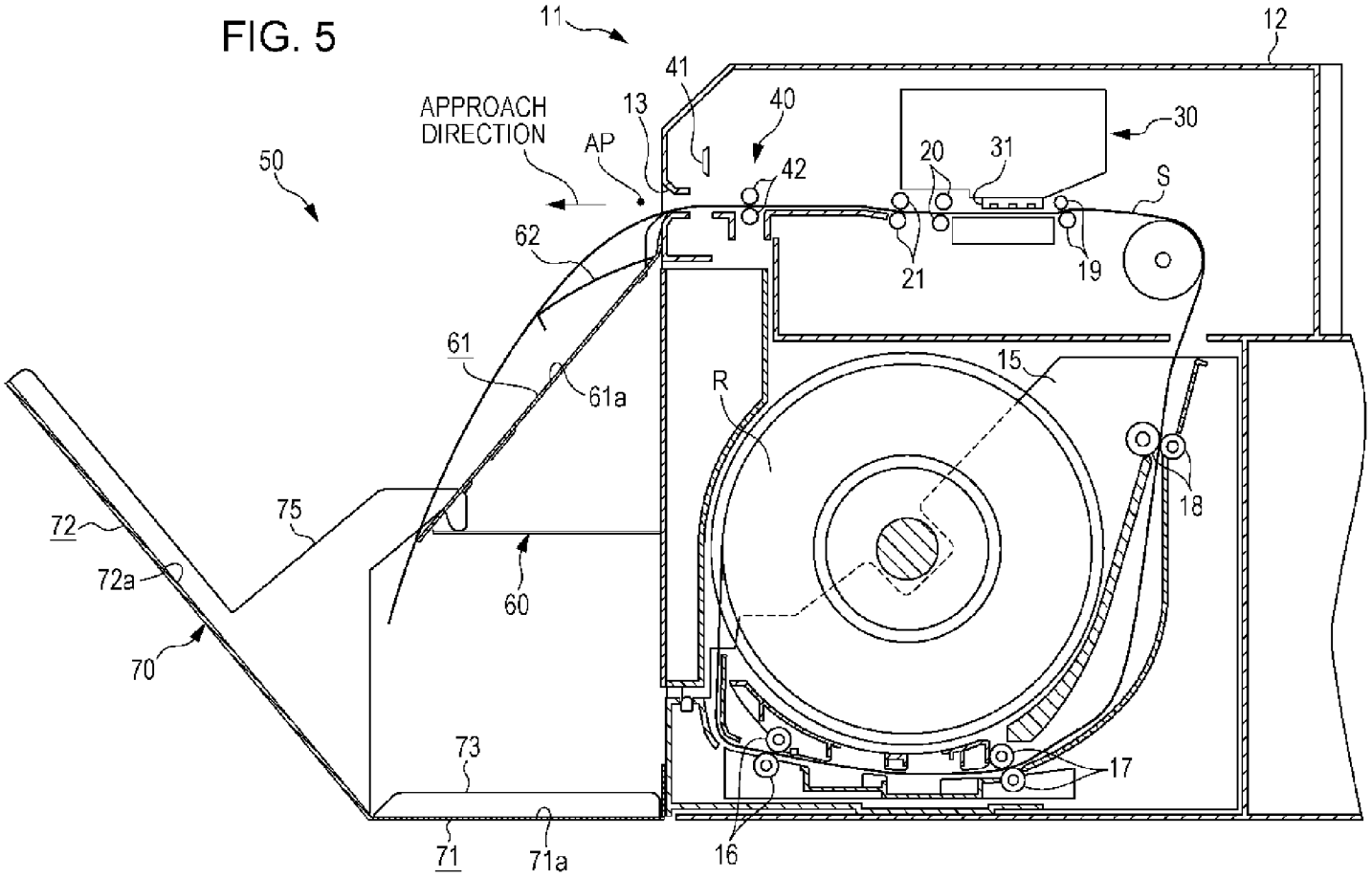
FIG. 5 is a cross-sectional side view showing a state just before the sheet is cut in the recording apparatus.

As shown in FIG. 5, if the sheet S further enters the stacker 50, a state is created where a leading end portion of the sheet S droops downward in the vertical direction. In this state, the amount of approach of the sheet S with respect to the stacker 50 is large, and thus its own weight of the sheet S acting on the elastic plate 62 which supports the sheet S increases. That is, the amount of displacement of the elastic plate 62 increases due to its own weight of the sheet S acting on the elastic plate 62, and thus a state is created where the elastic plate 62 is displaced toward the second position from the first position. Then, the sheet S is cut with the sheet S fixed by the pinching roller pair 42, and thus the recorded cut sheet CP is produced. In addition, in this embodiment, when the sheet S is cut, a state is created where the leading end of the sheet S is located further toward the lower side than the tip of the inclined portion 61 and the non-recording surface of the sheet S comes into contact with the tip of the inclined portion 61.

Figure 6:
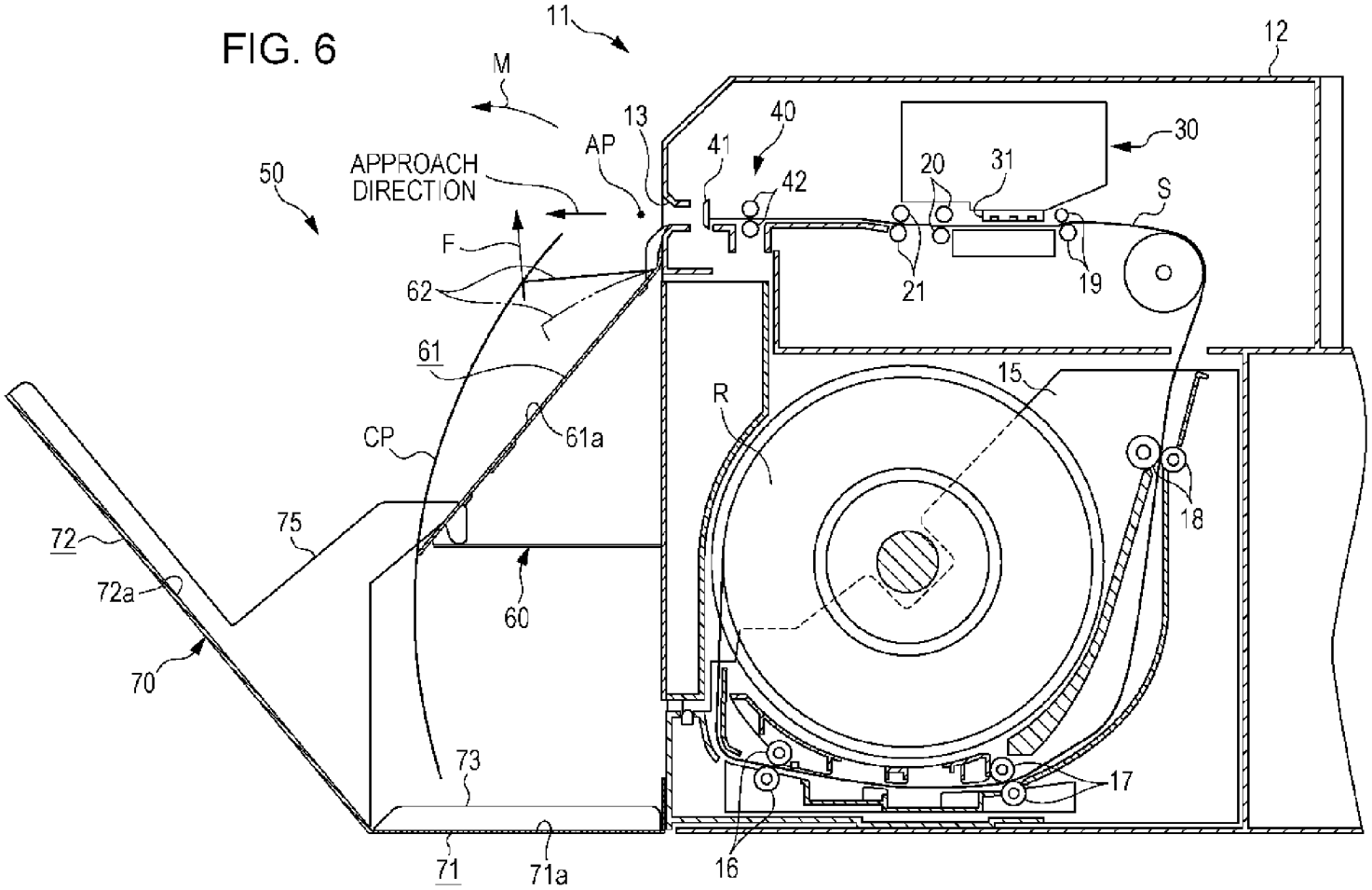
FIG. 6 is a cross-sectional side view showing a state after the sheet is cut in the recording apparatus.

As shown in FIG. 6, if the sheet S is cut and thus the cut sheet CP is produced, the cut sheet CP begins to fall while sliding on the elastic plate 62 and the tip of the inclined portion 61. At this time, a load acting on the elastic plate 62 according to its own weight of the cut sheet CP (the sheet S) which is applied to the elastic plate 62 is gradually reduced as the cut sheet CP falls. Then, elastic energy stored in the elastic plate 62 is released, whereby the elastic plate 62 is restored toward the first position shown by a solid line in FIG. 6 from the second position shown by a two-dot chain line in FIG. 6. At this time, the elastic plate 62 is in a state of being in contact with a rear end portion of the cut sheet CP, and therefore, when the elastic plate 62 is displaced (restored) toward the first position from the second position, the elastic plate 62 applies a pushing force F shown by a solid arrow in FIG. 6 in a direction toward the front in the approach direction and the upper side in the vertical direction to the rear end portion of the cut sheet CP from the non-recording surface side. In this respect, in this embodiment, the elastic plate 62 is equivalent to an example of a "pushing force applying section". Then, due to the pushing force F acting on the rear end portion of the cut sheet CP, a moment M having a rotation center further on the leading end side than the rear end portion, on which the pushing force F acts, acts on the cut sheet CP. Further, the elastic plate 62 is displaced (restored) toward the first position from the second position while applying the pushing force to the cut sheet CP. Here, the pushing force F is applied to the rear end portion of the cut sheet CP, and therefore, compared to, for example, a case of being applied to the position of the center of gravity of the cut sheet CP or further toward the leading end portion than the center of gravity of the cut sheet CP, it is possible to increase the moment M acting on the cut sheet CP. That is, since a moment is the product of the "length of an arm" and a "force (pushing force)", a pushing force is applied to the rear end portion of the cut sheet CP, whereby the length of an arm increases, and thus it is possible to increase the moment acting on the cut sheet CP.

Figure 7:
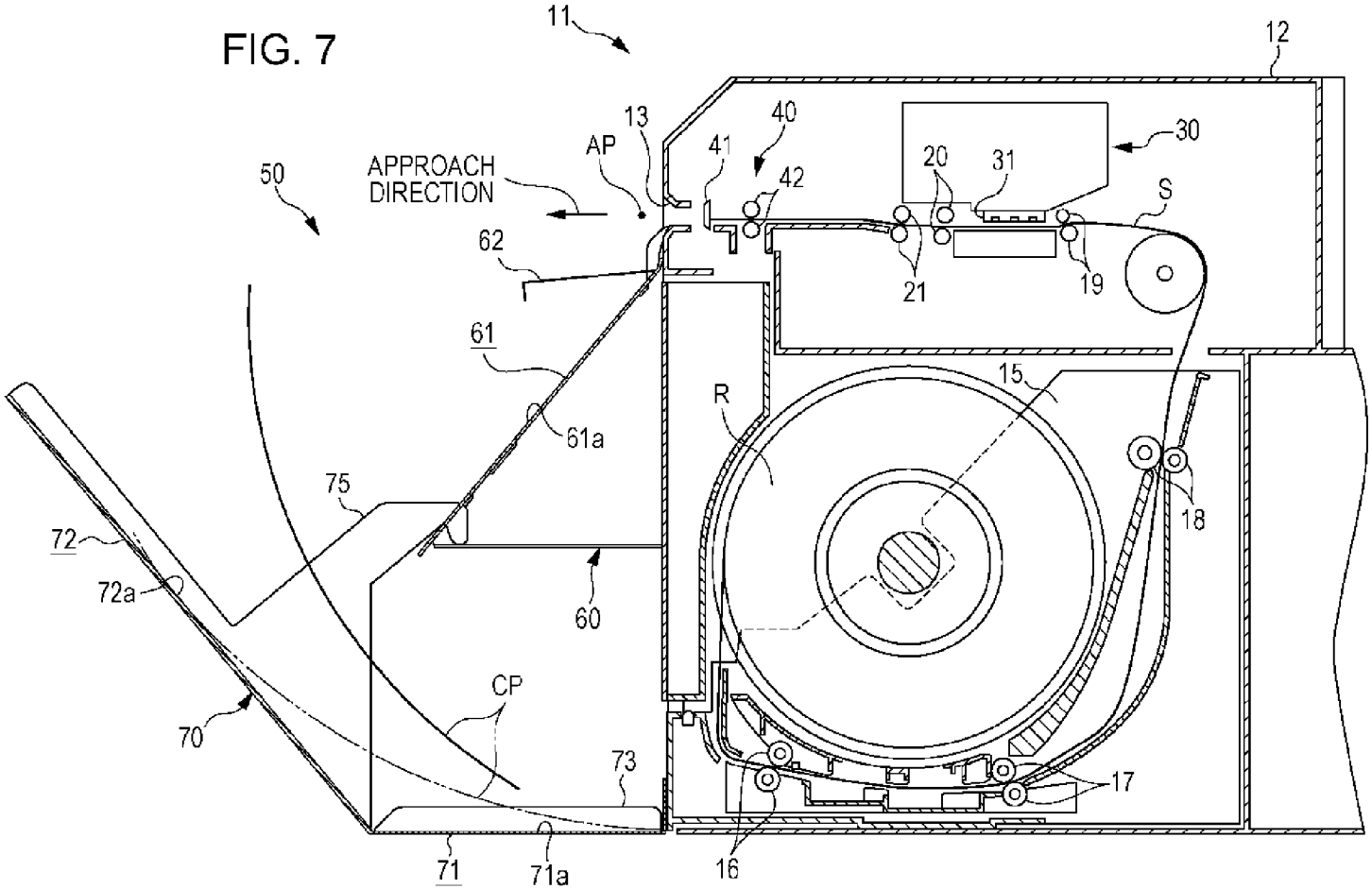
FIG. 7 is a cross-sectional side view showing a state where the cut sheet is loaded in the recording apparatus.

As shown in FIG. 7, if the moment M acts on the cut sheet CP, the rear end portion of the cut sheet CP is changed from a state where the recording surface faces upward in the vertical direction to a state where the non-recording surface faces upward in the vertical direction. Further, since together with the above-described moment M, the pushing force F to move the cut sheet CP to the front in the approach direction is applied to the cut sheet CP, the cut sheet CP flies forward in the vertical direction while rotating. Then, as shown by a two-dot chain line in FIG. 7, the cut sheet CP is loaded on the first loading portion 71 and the second loading portion 72 in a state where the cut sheet CP comes into contact with the first loading portion 71 and the second loading portion 72 in a state where the recording surface faces downward in the vertical direction and the non-recording surface faces upward in the vertical direction.

From the above, focusing on the amount of approach of the sheet S with respect to the stacker 50 and a change in the state of the elastic plate 62, the operation of the stacker 50 according to this embodiment can be explained as follows. That is, in the stacker 50, elastic energy is stored in the elastic plate 62 according to its own weight of the sheet S, which acts on the elastic plate 62, as the amount of approach of the sheet S with respect to the stacker 50 increases. Then, if the amount of approach of the sheet S with respect to the stacker 50 further increases, whereby its own weight of the sheet S acting on the elastic plate 62 is eliminated, the elastic plate 62 releases the elastic energy, thereby applying a pushing force to the rear end portion of the cut sheet CP. In this way, the moment M to reverse the front and the back of the cut sheet CP is generated while the pushing force F is applied to the rear end portion of the cut sheet CP. That is, according to this embodiment, it becomes possible to store elastic energy for applying a pushing force and also to make the pushing force act on the rear end of the cut sheet CP according to an increase in the amount of approach of the sheet S with respect to the stacker 50, in other words, according to a change in its own weight of the sheet S acting on the elastic plate 62. For this reason, according to the stacker 50 of this embodiment, if it is not necessary to provide a generation source to generate a pushing force, it is also not necessary to plan a timing to apply a pushing force to the rear end portion of the cut sheet CP.

Next, a case where the sheet S (the cut sheet CP) in which a curling tendency is strong is loaded on the stacker 50 will be described.

The recording apparatus 11 according to this embodiment performs recording on the sheet S wound into the roll body R, and therefore, according to the quality of a material of the sheet S (a medium type), a curling tendency to allow the first surface to be located outside and allow the second surface to be located inside is strong, and thus the recorded sheet S is sometimes curved (curled) as soon as it is discharged from the discharge port 13. Further, in the stacker 50, compared to the sheet S which is not curled, it is difficult to load the curled sheet S with the front and the back of the sheet S reversed.

Figure 8:
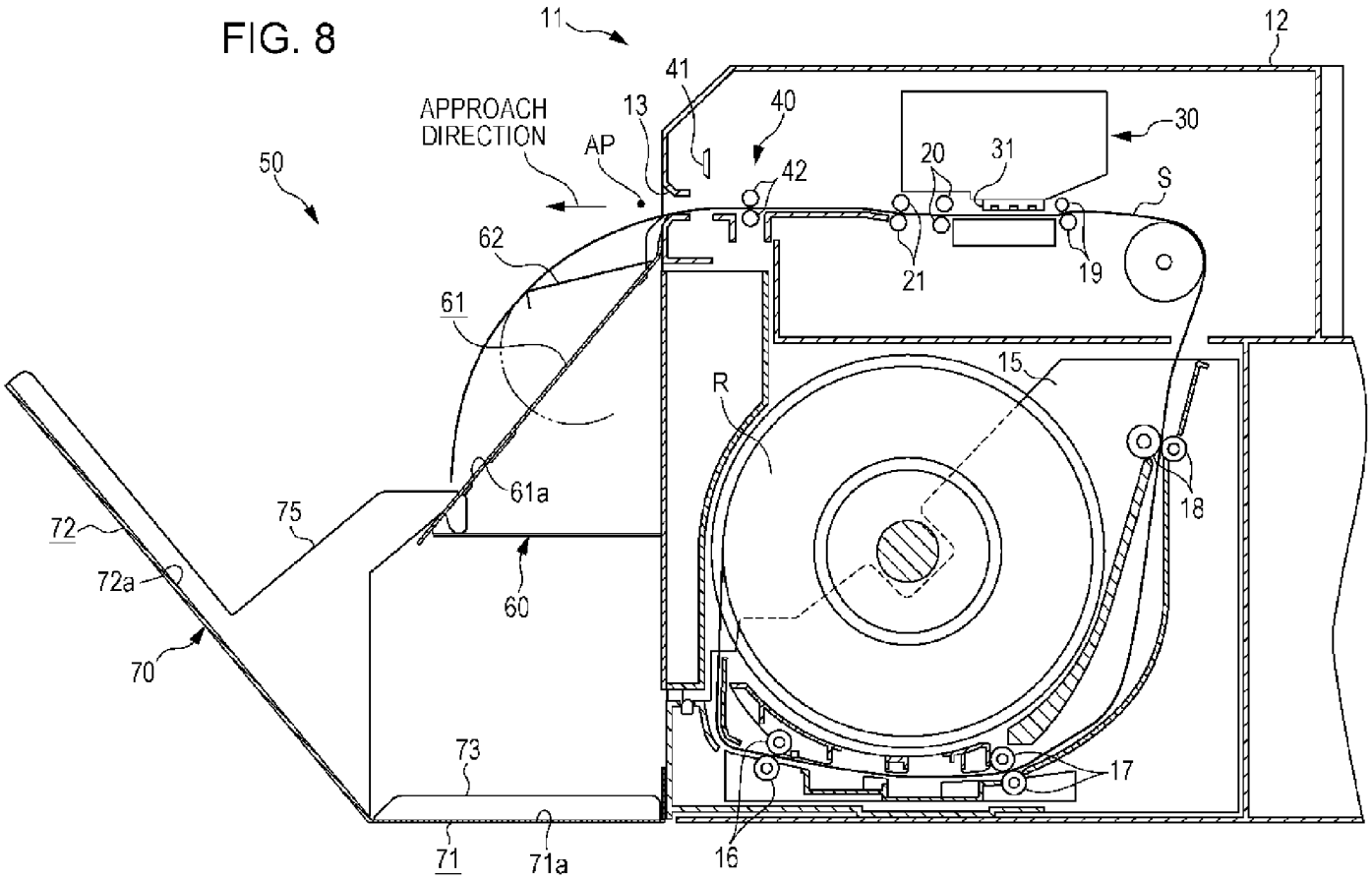
FIG. 8 is a cross-sectional side view showing a state where a sheet with a strong curling tendency begins to be discharged in the recording apparatus.

In this embodiment, the inclined portion 61 (the inclined surface 61*a*) is formed in the medium guide section 60, and therefore, the sheet S discharged from the discharge port 13, as shown by a solid line in FIG. 8, advances into the stacker 50 while the leading end thereof slides on the inclined surface 61*a*. That is, the sheet S discharged from the discharge port 13, as shown by a two-dot chain line in FIG. 8, is prevented from being immediately curled. In this way, even in the sheet S in which a curling tendency is strong, the inclined surface 61*a* is provided, whereby the sheet S advances to a position where it can be cut, in a state where curling is prevented.

Figure 9:
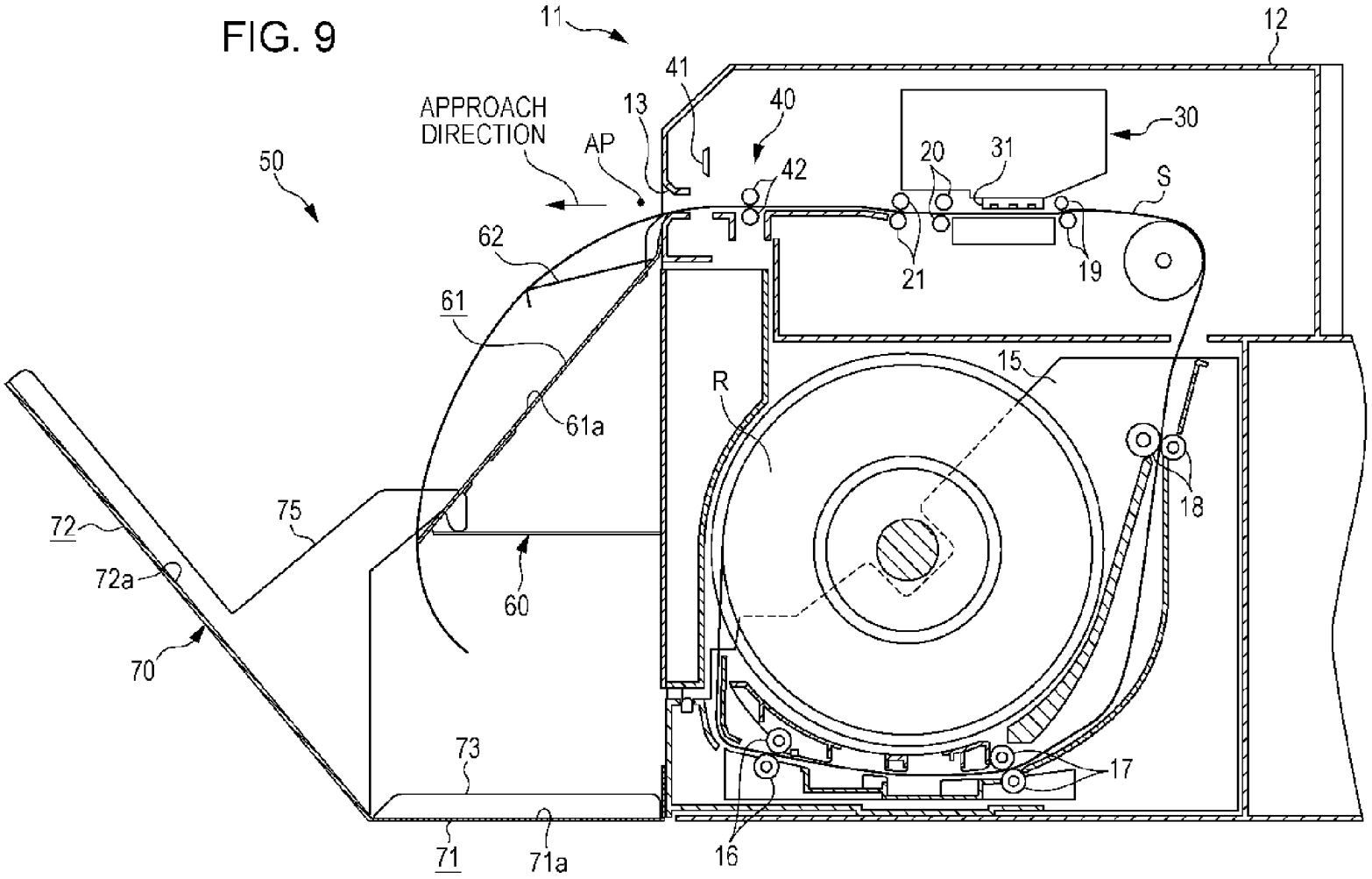
FIG. 9 is a cross-sectional side view showing a state just before the sheet with a strong curling tendency is cut in the recording apparatus.

Further, as shown in FIG. 9, in a case where the sheet S advances to a position where it can be cut, the non-recording surface of the sheet S comes into contact with the tip of the inclined portion 61, whereby a state where curling is restricted is created. In this way, even in the sheet S in which a curling tendency is strong, the inclined surface 61*a* is provided, whereby the sheet S is cut in a state where curling is restricted. In this way, the inclined portion 61 (the inclined surface 61*a*) is provided, whereby the front and the back of the cut sheet CP are stably reversed and the cut sheet CP is then loaded on the medium loading section 70.

According to the embodiment described above, the effects shown below can be obtained.

(1) If the sheet S enters the stacker 50, the sheet S is supported from the lower side in the vertical direction by the elastic plate 62. Here, the elastic plate 62 is displaced toward the second position from the first position due to its own weight of the sheet S acting thereon. Then, if the sheet S is cut, its own weight of the sheet S acting on the elastic plate 62 is gradually eliminated, whereby the elastic plate 62 is gradually displaced (restored) toward the first position from the second position. Then, the elastic plate 62 applies a pushing force to the rear end portion of the cut sheet CP from the non-recording surface according to this displacement, and thus a moment to rotate the cut sheet CP is generated. That is, due to such a pushing force and a moment, the cut sheet CP is loaded in a state where the front and the back thereof are reversed and thus the recording surface faces downward in the vertical direction. In this way, with a simple configuration, it is possible to apply a pushing force to the rear end portion of the sheet S (the cut sheet CP) based on a change in an aspect supporting the sheet S (the cut sheet CP) of the elastic plate 62 according to an increase in the amount of approach of the sheet S (the cut sheet CP) with respect to the stacker 50. Then, due to such a pushing force, it is possible to load the cut sheet CP on the medium loading section 70 with the front and the back of the cut sheet CP reversed.

(2) The elastic plate 62 applies a pushing force to the non-recording surface and meanwhile, the elastic plate 62 does not apply a pushing force to the recording surface. For this reason, the recording surface and the elastic plate 62 do not perform contact and sliding with respect to each other, and therefore, it is possible to load the cut sheet CP with the front and the back of the cut sheet CP reversed while preventing damage to a recorded image or the like of the recording surface.

(3) Since the elastic plate 62 is configured of a single member made of an elastic material, a biasing member for biasing the elastic plate 62 is not required, and thus it is possible to simplify the configuration of the stacker 50.

(4) When the sheet S having a curling tendency enters the stacker 50 and when the sheet S is cut, the leading end of the sheet S comes into contact with the inclined portion 61 (the inclined surface 61*a*), whereby the sheet S is prevented from being curled. For this reason, compared to a case where the inclined surface 61*a* is not provided, it is possible to easily reverse the front and the back of the sheet S (the cut sheet CP).

(5) The cut sheet CP is loaded on the medium loading section 70 in a state where a relative positional relationship between the medium loading section 70 and the medium guide section 60 is positioned. For this reason, for example, in a case of loading a plurality of cut sheets CP on the stacker 50, it is possible to prevent variation from occurring in the loading positions of the plurality of cut sheets CP with respect to the medium loading section 70. Therefore, it is possible to prevent occurrence of poor loading of the cut sheets CP due to variation in the loading positions of the cut sheets CP.

(6) The relative positional relationship between the medium guide section 60 and the medium loading section 70 can be changed by selectively using the plurality of locking holes 64 and 65 of the medium guide section 60. For this reason, by setting such a positional relationship to be a positional relationship most suitable for the size of the sheet S (the cut sheet CP) entering the stacker 50, it is possible to properly load the sheets S (the cut sheets CP) having different sizes on the medium loading section 70.

(7) In the medium loading section 70, at least a portion of the cut sheet CP is loaded on the second loading portion 72, and therefore, at least a portion of the cut sheet CP is loaded in a state of being inclined in a direction intersecting the approach direction and the vertical direction. Therefore, compared to a medium loading section on which the entirety of the cut sheet CP is loaded in a state of extending in the approach direction, it is possible to shorten the length dimension in the approach direction of the medium loading section 70. Therefore, it is possible to make the stacker 50 compact in the approach direction.

In addition, the above-described embodiment may be modified as shown below.

Figure 10A:
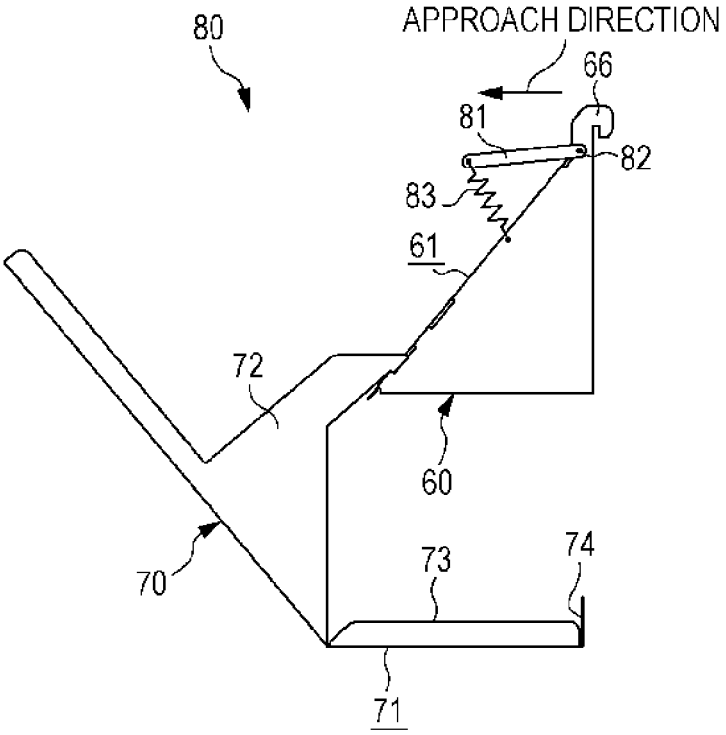
FIGS. 10A and 10B are side views of a stacker of a modified example.
Figure 10B:
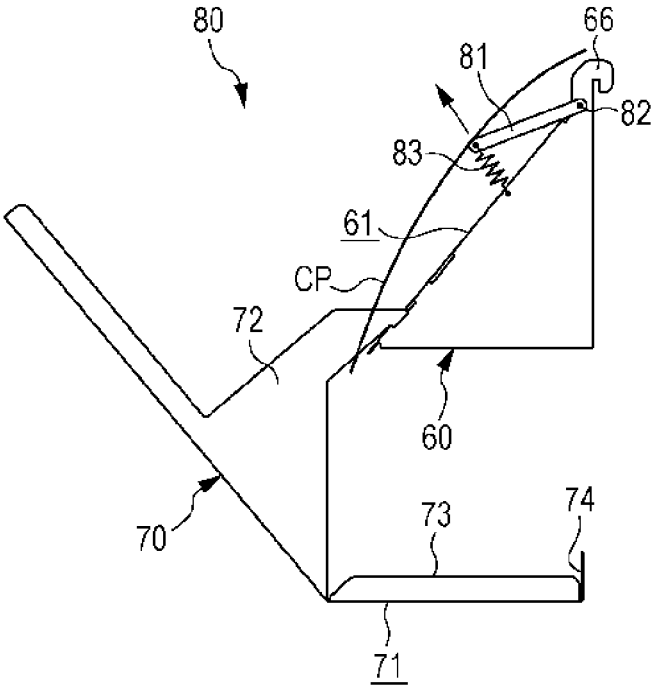

As shown in FIG. 10A, the stacker 50 may be a stacker 80 which is provided with a plate-like member 81 that is a non-elastic body, as an example of the pushing force applying section, a pin 82 for pin-connection of a base end of the plate-like member 81 to the medium guide section 60, and a spring 83 which biases the tip of the plate-like member 81 in a direction away from the inclined portion 61. In this case, it is preferable that the plate-like member 81 have a longitudinal direction in the width direction of the recording apparatus 11 and can support the sheet S from the lower side in the vertical direction over the width direction. Further, as shown in FIG. 10B, it is preferable that the plate-like member 81 support the sheet S thereon, thereby being able to rotate with the pin 82 as a rotation center in a direction in which the tip of the plate-like member 81 comes close to the inclined portion 61. Then, it is preferable that the plate-like member 81 apply a pushing force to the rear end portion of the sheet S by returning to the position shown in FIG. 10A according to the elimination of a support state of the sheet S.

Also by such a configuration, the same effects as the effects (1), (2), and (4) to (7) of the above-described embodiment can be obtained.

Figure 11A:
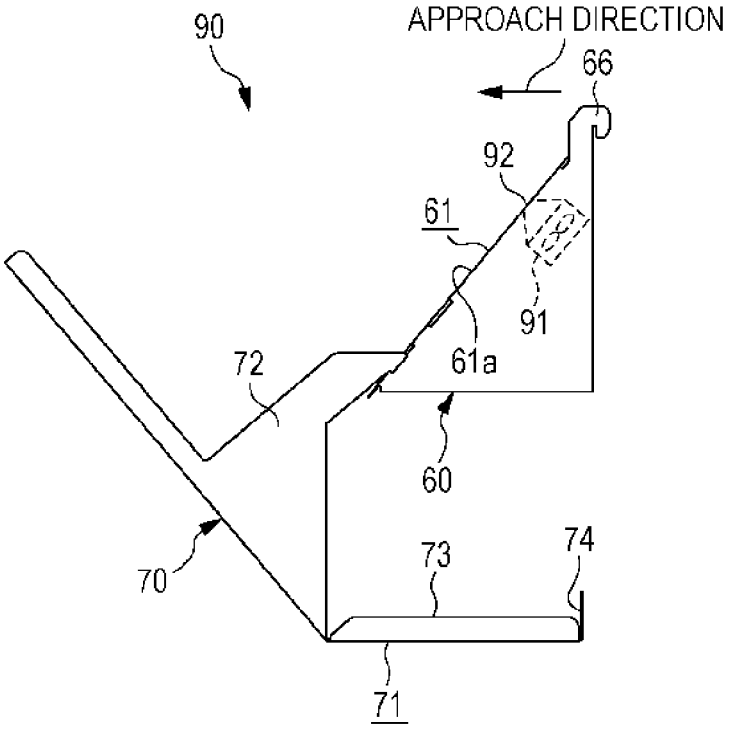
FIGS. 11A and 11B are side views of a stacker of another modified example.

As shown in FIG. 11A, the stacker 50 may be a stacker 90 provided with an air blowing section 91 which blows gas on the non-recording surface of the cut sheet CP, as an example of the pushing force applying section. In this case, it is preferable that a slit 92 through which gas can pass be formed over the width direction in the inclined surface 61*a* of the medium guide section 60. Further, it is preferable that the stacker 90 be further provided with a detection section which detects the position of the cut sheet CP in the stacker 90, and a control section which drives and controls the air blowing section according to the detection result of the detection section, in order to make it possible to blow gas on an optional site (the rear end portion) of the non-recording surface of the cut sheet CP.

Figure 11B:
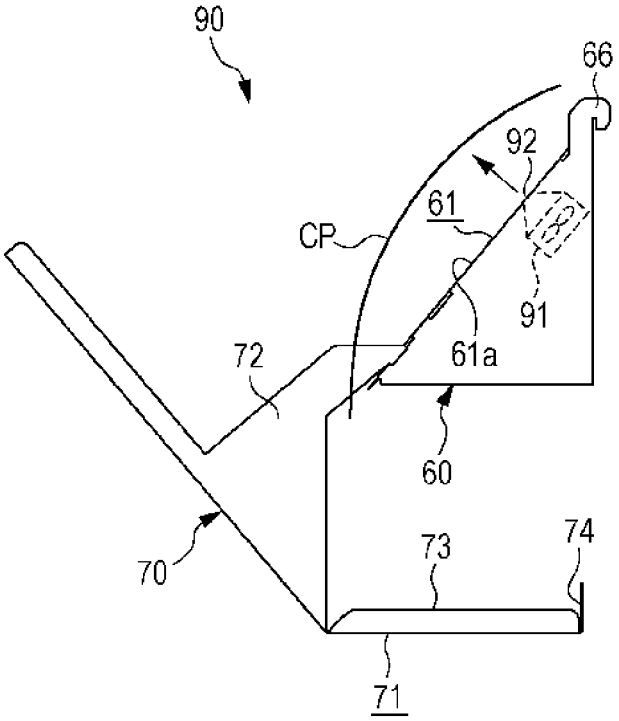

For example, a configuration may be made such that elapsed time after the cutting section 40 cuts the sheet S and until the rear end portion of the cut sheet CP reaches a position facing the air blowing section 91 is measured by an experiment or the like in advance and the air blowing section 91 blows gas on the rear end portion of the cut sheet CP, as shown in FIG. 11B, based on the elapsed time. In this case, the detection section detects the cutting of the sheet S by the cutting section 40 and the control section drives the air blowing section 91 based on the elapsed time from the detection of the cutting of the sheet S by the detection section.

Further, a configuration may be made such that the air blowing section 91 blows gas on the cut sheet CP, as shown in FIG. 11B, at the timing when the rear end portion of the cut sheet CP has passed through the discharge port 13 of the recording apparatus 11. In this case, the detection section detects the presence or absence of paper at the discharge port 13 of the recording apparatus 11 and the control section drives the air blowing section 91 based on the detection result by the detection section indicating the absence of paper.

Also by such a configuration, the same effects as the effects (2), and (4) to (7) of the above-described embodiment can be obtained. In addition, in the reversing of the front and the back of the cut sheet CP, the cut sheet CP and the air blowing section 91 do not perform contact or sliding with respect to each other, and therefore, it is possible to reverse the front and the back of the cut sheet CP while avoiding physical contact with the cut sheet CP.

In addition, if the cut sheet CP can be loaded on the medium loading section 70 with the front and the back of the cut sheet CP reversed, the air blowing section 91 may be driven at all times. In this case, the detection section and the control section described above are not required. Further, in a case where the recording apparatus 11 is provided with a suction fan or an exhaust fan, an air current which is generated by such a fan may be discharged from the slit 92.

A medium which enters the stacker 50 may not be the sheet S and the cut sheet CP which is produced by cutting the sheet S. That is, a single sheet cut into an A4-size or the like in advance is also acceptable.

As a substitute for the elastic plate 62, a plurality of needle-shaped members having a longitudinal direction in the approach direction may be used. In this case, it is preferable that the needle-shaped members be able to be elastically deformed according to its own weight of the sheet S (the cut sheet CP). Furthermore, a brush-like member formed by assembling a plurality of needle-shaped members is also acceptable.

The medium guide section 60 may not be provided with the inclined portion 61. However, it is preferable that the medium guide section 60 be provided with at least the elastic plate 62. In this case, for example, it is favorable if the elastic plate 62 is stuck to the lower side in the vertical direction of the discharge port 13 of the recording apparatus 11.

The medium loading section 70 may not be positioned at the medium guide section 60 by locking the locking portion 76 to the locking hole 64 or 65. For example, the medium loading section 70 may be positioned at the medium guide section 60 by a hook-and-loop fastener, and the medium loading section 70 may be positioned at the medium guide section 60 by a bolt and a nut.

Any one of the locking holes 64 and 65 may not be provided.

The second loading portion 72 in the medium loading section 70 may not be provided. In this case, it is preferable that the first loading portion 71 extend long in the approach direction.

The recording apparatus 11 may be a recording apparatus which performs recording by transporting a single sheet. In this case, the cutting section 40 may not be provided. In this case, the single sheet is transported to the recording apparatus 11, thereby entering the stacker 50.

The sheet S (the cut sheet CP) is not limited to paper and may be a plastic film, a thin plate material, or the like or may also be cloth which is used in a textile printing apparatus or the like. However, it is preferable that such a medium be a medium having some degree of elasticity and capable of generating a moment when a pushing force is applied thereto.

The recording apparatus 11 is not limited to a printer which performs recording by ejecting a fluid such as ink and may be a non-impact printer such as a laser printer, an LED printer, or a thermal-transfer printer (including a sublimation printer), for example, or may also be an impact printer such as a dot impact printer.

The entire disclosure of Japanese Patent Application No. 2013-247387, filed Nov. 29, 2013 is expressly incorporated by reference herein.

What is claimed is:

1. A stacker on which a medium that has entered with a direction intersecting a vertical direction as an approach direction in a state where a first surface faces upward in the vertical direction is loaded in a state where the first surface faces downward in the vertical direction, the stacker comprising:

a pushing force applying section capable of applying a pushing force to the entered medium from a second surface that is a rear surface of the first surface to rotate the entered medium against a portion of a medium guide section contacting the second surface; and a medium loading section which is provided further toward the lower side in the vertical direction than the pushing force applying section and on which the medium can be loaded, wherein the pushing force applying section can support the medium by coming into contact with the second surface of the medium, can be displaced from a first position toward a second position that is a position further toward the lower side in the vertical direction than the first position, and is biased toward the first position from the second position.

2. The stacker according to claim 1, wherein the pushing force applying section is elastically deformable.

3. A recording apparatus comprising:

the stacker according to claim 2; and a recording section which performs recording on the medium.

4. The stacker according to claim 1, wherein the pushing force applying section applies a pushing force to the medium by blowing gas on the second surface of the medium.

5. A recording apparatus comprising:

the stacker according to claim 4; and a recording section which performs recording on the medium.

6. The stacker according to claim 1, further comprising:

the medium guide section is provided further toward the lower side in the vertical direction than an approach position and has an inclined surface which is directed downward in the vertical direction as it goes forward in the approach direction.

7. The stacker according to claim 6, wherein the medium guide section has a positioning portion which determines a relative position with respect to the medium loading section in the approach direction and the vertical direction.

8. A recording apparatus comprising:

the stacker according to claim 7; and a recording section which performs recording on the medium.

9. A recording apparatus comprising:

the stacker according to claim 6; and a recording section which performs recording on the medium.

10. The stacker according to claim 1, wherein the medium guide section has a plurality of positioning portions.

11. A recording apparatus comprising:

the stacker according to claim 10; and a recording section which performs recording on the medium.

12. The stacker according to claim 1, wherein the medium loading section has an inclined loading portion having an inclined surface which is directed upward in the vertical direction as it goes forward in the approach direction.

13. A recording apparatus comprising:

the stacker according to claim 12; and a recording section which performs recording on the medium.

14. A recording apparatus comprising:

the stacker according to claim 1; and a recording section which performs recording on the medium.

* * * * *